US006927352B2

(12) United States Patent
Bouche et al.

(10) Patent No.: US 6,927,352 B2
(45) Date of Patent: Aug. 9, 2005

(54) LATERAL DISPLACEMENT MULTIPOSITION MICROSWITCH

(75) Inventors: Guillaume Bouche, Grenoble (FR); Daniel Saias, Paris (FR)

(73) Assignee: STMicroelectronics S.A., Montrouge (FR)

( * ) Notice: Subject to any disclaimer, the term of this patent is extended or adjusted under 35 U.S.C. 154(b) by 0 days.

(21) Appl. No.: 10/841,180

(22) Filed: May 7, 2004

(65) Prior Publication Data

US 2004/0222074 A1 Nov. 11, 2004

(30) Foreign Application Priority Data

May 9, 2003 (FR) ..... 03 05649

(51) Int. Cl.[7] ..... H01H 13/70; H01N 9/00

(52) U.S. Cl. ..... 200/512; 200/181; 200/513; 200/514; 200/517; 335/78; 335/82; 335/85; 335/107

(58) Field of Search ..... 200/181, 511–517; 335/78–85, 107

(56) References Cited

U.S. PATENT DOCUMENTS 4,668,843 A * 5/1987 Watanabe et al. ..... 200/5 A
4,839,474 A * 6/1989 Hayes-Pankhurst et al. 200/5 A
5,824,978 A * 10/1998 Karasik et al. ..... 200/18
5,871,088 A * 2/1999 Tanabe ..... 200/514
6,168,395 B1 1/2001 Quenzer et al. ..... 417/413.3
6,373,008 B1 * 4/2002 Saito et al. ..... 200/310
6,483,056 B2 * 11/2002 Hyman et al. ..... 200/181
6,584,678 B2 * 7/2003 Burgess et al. ..... 29/622
2002/0097133 A1 7/2002 Charvet et al. ..... 337/27

FOREIGN PATENT DOCUMENTS

DE 199 37 811 A1 3/2001
EP 1 026 718 A2 8/2000
WO WO 99/62089 12/1999

* cited by examiner

*Primary Examiner*—Ramon M. Barrera
(74) *Attorney, Agent, or Firm*—Lisa K. Jorgenson; Robert Iannucci; Seed IP Law Group PLLC

(57) ABSTRACT

A multiposition microswitch that includes a cavity, a mobile portion made of a deformable material extending above the cavity, at least three conductive tracks extending on the cavity bottom, and a contact pad on the lower surface of the mobile part. The mobile part is capable of deforming, under the action of a stressing mechanism, from an idle position where the contact pad is distant from the conductive tracks to an on position from among several distinct on positions. The contact pad electrically connects, in each distinct on position, at least two of the at least three conductive tracks, at least one of the conductive tracks connected to the contact pad in each distinct on position being different from the conductive tracks connected to the contact pad in the other distinct on positions.

28 Claims, 3 Drawing Sheets

LATERAL DISPLACEMENT MULTIPOSITION MICROSWITCH

BACKGROUND OF THE INVENTION

1. Field of the Invention

The present invention relates to a three-position microswitch.

2. Description of the Related Art

The function of switching from an on state (ON) to an off state (OFF) may be performed by an electronic microcomponent such as a diode or a transistor. A major disadvantage of such microcomponents is that they exhibit on-state insertion losses and off-state leakage. To overcome this disadvantage, mechanical dual-position microswitches that limit insertion losses in closed position, i.e., in the on state, and exhibit a good isolation in open position, i.e., in the off state, may be used.

A conventional dual-position microswitch is shown in FIGS. 1A and 1B, where FIG. 1A shows a top view of the microswitch and FIG. 1B shows a cross-section view of the microswitch of FIG. 1A along line 1B—1B.

Microswitch 10 is formed on a substrate 12, for example, silicon, covered with an oxide layer 14, for example, silicon oxide. Oxide layer 14 comprises a parallelepiped-shaped cavity 16. The depth of cavity 16 is smaller than the thickness of oxide layer 14. A silicon nitride strip 18 extends over oxide layer 14 and spans cavity 16. The portion of silicon nitride strip 18 above cavity 16 forms a silicon nitride beam 20. In the absence of an external force, beam 20 has a convex shape so that it is at its farthest from the bottom of cavity 16 in its median portion.

Two conductive tracks 22, 24 extend on the bottom of cavity 16, substantially in prolongation of each other. The ends of conductive tracks 22, 24 are placed opposite to each other below beam 20. Two metal portions 26, 28 cover beam 20 close to its ends. Each metal portion 26, 28 forms with the portion of the underlying beam a structure that behaves as a bimetal. Two metal electrodes 30, 32 are arranged on the bottom of cavity 16 on either side of conductive tracks 22, 24 substantially below beam 20.

As shown in FIG. 1B, beam 20 comprises a contact pad 34 located on the surface of beam 20 opposite to the bottom of cavity 16. Two heating elements 36, 38 are comprised in beam 20 substantially opposite to metal portions 26, 28. Two complementary metal electrodes 40 and 42 are also comprised in beam 20 substantially opposite to electrodes 30, 32.

As shown in FIG. 1B, beam 20 takes at equilibrium a convex shape so that contact pad 34 is remote from conductive tracks 22, 24. Microswitch 10 then is in the off or open state.

To turn on microswitch 10, a current is run through heating elements 36, 38. The heat released by Joule effect causes a deformation of beam 20 that tends, in its central portion, to come closer to the bottom of cavity 16. The deformation is due to the expansion difference between metal portions 26, 28 and the areas of beam 20 around heating elements 36, 38, with metal portions 26, 28 expanding more. The expansion difference is sufficient to obtain the buckling of the central portion of beam 20.

FIG. 1C shows the microswitch after complete deformation of beam 20. Contact pad 34 is then in contact with both conductive tracks 22, 24. An electric connection between the two conductive tracks 22, 24 is thus obtained.

The supply of heating elements 36, 38 is then cut off. To maintain microswitch 10 on, a potential difference is applied between electrodes 30, 32 and complementary electrodes 40, 42. The resulting electrostatic forces tend to bring electrodes 30, 32 closer to complementary electrodes 40, 42, and to maintain pad 34 in contact with conductive tracks 22, 24.

In many applications, a microswitch with one off state and at least two on states is desired to be formed. For example, a microswitch with one off state and two on states having one input, a first output and a second output, is desired to be formed. Such a microswitch may have an off state corresponding to no connection between the input and the outputs, a first on state corresponding to the connection of the input to the first output and a second on state corresponding to the connection of the input to the second output.

To obtain a microswitch with one off position and two on positions that limits insertion losses and exhibits a good isolation, two dual-position microswitches of the type shown in FIGS. 1A to 1C may be combined. However, the obtained three-position microswitch takes up a significant space, generally at least the space taken up by the dual-position microswitch. Further, for same manufacturing technologies, the probability of obtaining such a three-position microswitch which is defective is greater than the probability of obtaining a dual-position microswitch which is defective. Further, it is necessary to double the electric control, especially the supply circuits of heating elements 36, 38.

BRIEF SUMMARY OF THE INVENTION

One embodiment of the present invention provides a microswitch with at least three positions that does not exhibit the above-mentioned disadvantages.

One embodiment of the present invention provides a multiposition microswitch, comprising a cavity formed in an insulating support, a mobile portion made of a deformable material extending above said cavity and connected at its ends to the insulating support, at least three conductive tracks extending on the cavity bottom, a contact pad on the lower surface of the mobile part, the mobile part being capable of deforming, under the action of a stressing means, from an idle position where the contact pad is distant from the conductive tracks to an on position from among several distinct on positions, the contact pad electrically connecting, in each distinct on position, at least two of the at least three conductive tracks, at least one of the conductive tracks connected to the contact pad in each distinct on position being different from the conductive tracks connected to the contact pad in the other distinct on positions.

According to an embodiment of the present invention, the stressing means is capable of providing forces of attraction on the mobile part to maintain it in one of the distinct on positions.

According to an embodiment of the present invention, the stressing means is capable of providing forces of attraction on the mobile portion to deform it from the idle position selectively to one of the distinct on positions.

According to an embodiment of the present invention, the mobile portion is a beam spanning the cavity, the beam ends being connected to the isolating support and the beam is capable of deforming from the idle position to a first on position where the contact pad electrically connects two first conductive tracks or to a second on position, distinct from the first on position, where the contact pad electrically connects two second conductive tracks, at least one of the second conductive tracks being distinct from the first conductive tracks.

According to an embodiment of the present invention, the stressing means comprises first and second electrodes in the cavity and first and second complementary electrodes connected to the beam and respectively associated with the first and second electrodes, a potential difference being applied between the first electrode and the first complementary electrode to deform the beam from the idle position to the first on position, and a potential difference being applied between the second electrode and the second complementary electrode to deform the beam from the idle position to the second on position.

According to an embodiment of the present invention, the stressing means comprises heating elements comprised in the mobile portion, each heating element being located close to an end of the mobile portion and being capable of providing heat upon flowing of a current.

According to an embodiment of the present invention, the stressing means comprises expandable portions formed of a material having an expansion coefficient greater than that of the mobile portion, each expandable portion being connected to the mobile portion on the side opposite to the cavity, and arranged at one end of the mobile portion.

According to an embodiment of the present invention, the stressing means comprises first and second expandable portions respectively arranged close to each beam end, the beam being capable of deforming to the first on position when the first expandable portion is heated, the second expandable portion being not or only slightly heated and being capable of deforming to the second on position when the second expendable portion is heated, the first expandable portion being not or only slightly heated.

According to an embodiment of the present invention, the beam is rectilinear in its idle position.

According to an embodiment of the present invention, the mobile portion is made of a polymer.

The foregoing features, and advantages of the present invention will be discussed in detail in the following non-limiting description of specific embodiments in connection with the accompanying drawings.

DETAILED DESCRIPTION OF THE INVENTION

One operating principle of a microswitch with at least three positions according to one embodiment of the present invention includes providing a resilient mobile part that can be deformed in dissymmetrical fashion from an off position to at least two different on positions. When the mobile part is deformed to a given distinct on position, a single contact pad supported by the mobile part electrically connects at least two conductive tracks. For each distinct on position, at least one of the conductive tracks connected to the contact pad is distinct from the conductive tracks connected to the contact pad for the other distinct on position.

An example of the forming of a three-position microswitch will be described in detail hereafter. As conventional in the representation of microcomponents, the various drawings are not drawn to scale.

Figure 1A:
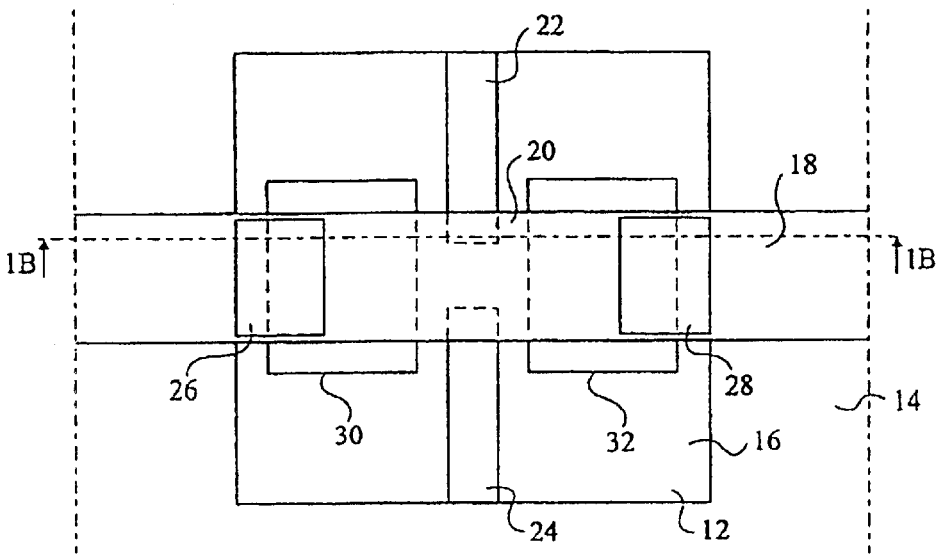
Fig 1A (PRIOR ART)
FIGS. 1A to 1C, previously described, show a conventional dual-position microswitch.
Figure 1B:
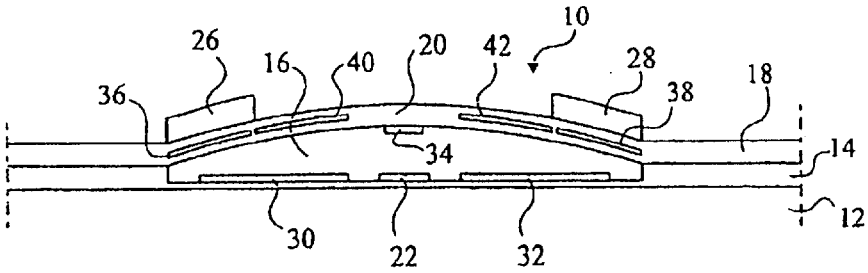
Fig 1B (PRIOR ART)
Figure 1C:
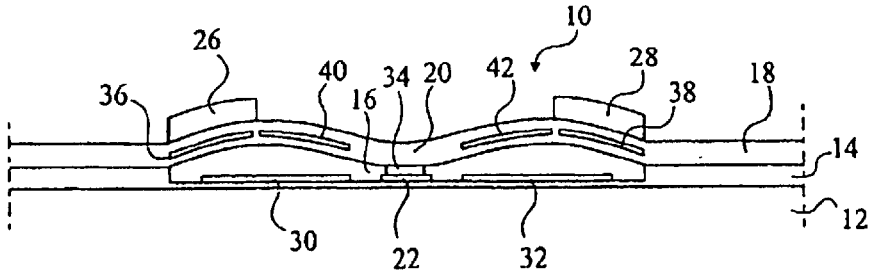
Fig 1C (PRIOR ART)
Figure 2A:
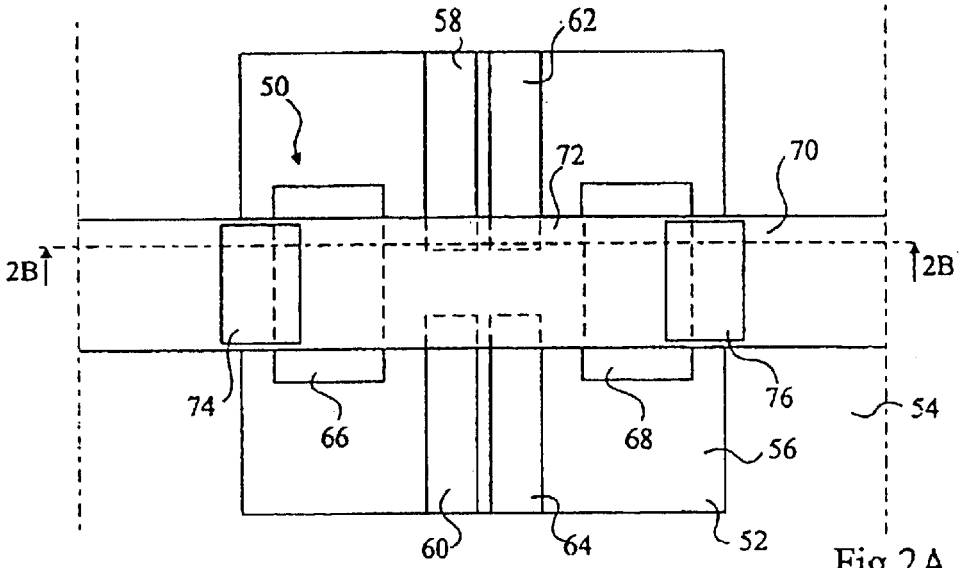
FIGS. 2A to 2E show examples of the forming of a three-position microswitches according to the present invention.
Figure 2B:
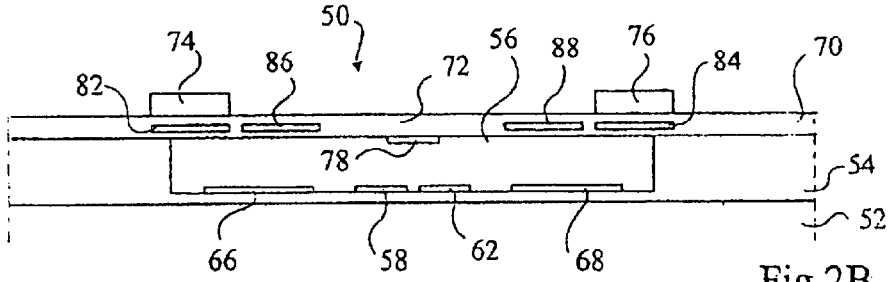
Figure 2C:
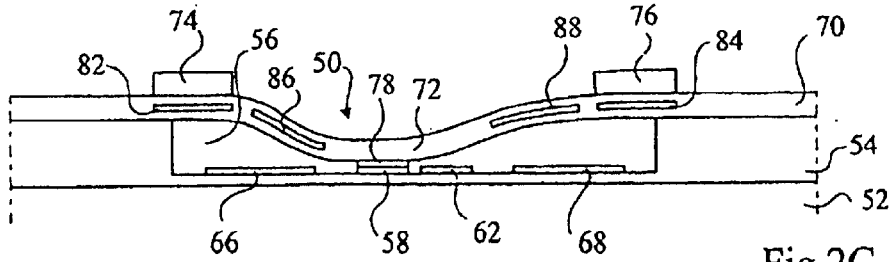

FIG. 2A shows a top view of an example of the forming of a three-position microswitch 50 according to the present invention. FIG. 2B shows a cross-section view of FIG. 2A along line 2B—2B.

Microswitch 50 is formed on a substrate 52, for example, made of silicon, covered with an oxide layer 54, for example, a silicon oxide layer. Insulating layer 54 comprises a cavity 56 having a depth of, for example, from 1 to 2 micrometers. The depth of cavity 56 is smaller than the thickness of insulating layer 54 to avoid exposing substrate 52.

Two first conductive tracks 58, 60, shown to the left of FIG. 2A, extend over the bottom of cavity 56 in prolongation of each other and have opposite ends. Two second conductive tracks 62, 64, shown to the right of FIG. 2A, extend over the bottom of cavity 56 in prolongation of each other and parallel to first tracks 58, 60 and exhibit opposite ends. Conductive tracks 58, 60, 62, 64 are intended to be connected to other electronic components. Metal electrodes 66, 68 are arranged at the bottom of cavity 56 on either side of conductive tracks 58, 60, 62, 64.

A strip 70 of a flexible material with a high expansion coefficient, for example, a polymer, extends over oxide layer 54 and spans cavity 56. The portion of strip 70 above cavity 56 forms a beam 72. The length, the width, and the thickness of beam 72 may respectively vary from 400 to 600 micrometers, from 40 to 100 micrometers, and from 0.5 to 2 micrometers.

The portions of conductive tracks 58, 60, 62, 64, and of electrodes 66, 68 hid in FIG. 2A by beam 72 are shown in dotted lines. A first metal portion 74, for example, aluminum, is arranged on the surface of beam 72 opposite to the bottom of cavity 56 close to the end of beam 72 shown to the left of FIG. 2A. A second metal portion 76, for example, made of aluminum, is arranged on the surface of beam 72 opposite to the bottom of cavity 56 close to the end of beam 72 shown to the right of FIG. 2A.

As appears in FIG. 2B, a contact pad 78 is arranged on the surface of beam 72 opposite to the bottom of cavity 56. Contact pad 78 is for example substantially equidistant from the opposite ends of the first 58, 60 and second 62, 64 conductive tracks. Conductive tracks 58, 60, 62, 64, and contact pad 78 may be made of gold to obtain a fine-quality contact. Electrodes 66, 68 may be formed at the same time as conductive tracks 58, 60, 62, 64 and are then made of gold.

First and second heating elements 82, 84, for example, made of a titanium and titanium nitride alloy, are comprised in beam 72. First and second heating elements 82, 84 are respectively arranged substantially at the level of the first and second metal portions 74, 76. Beam 72 also comprises complementary metal electrodes 86, 88, for example, made of aluminum, respectively arranged substantially above electrodes 66, 68.

A method for manufacturing microswitch 50 according to one embodiment of the present invention may comprise the steps of:

- depositing silicon oxide layer 54 on substrate 52;
- etching cavity 56 in oxide layer 54;
- forming on the bottom of cavity 56 conductive tracks 58, 60, 62, 64 and electrodes 66, 68;
- depositing a sacrificial material, for example, resin or an oxide;
- etching, for example, by chem.-mech polishing, the sacrificial material down to oxide layer 54 so that only cavity 56 remains filled with a sacrificial material;
- forming on the sacrificial material contact pad 78;
- forming rectilinear silicon nitride beam 72 that extends on oxide layer 54, the sacrificial material and contact pad 78, adhering to contact pad 78 and containing heating elements 82, 84 and complementary electrodes 86, 88;

forming metal portions 74, 76 on beam 72; and etching the sacrificial material.

It will be considered hereafter that microswitch 50 is in an off position when conductive tracks 58, 60, 62, 64 are not interconnected, in a first on position when first conductive tracks 58, 60 are interconnected, and in a second on position when second conductive tracks 62, 64 are interconnected.

FIG. 2B shows microswitch 50 according to the present invention in the off position. This position is obtained when heating elements 82, 84 are not supplied with a current and when no voltage difference is applied between complementary electrodes 86, 88 and electrodes 66, 68. In this state, beam 72 is rectilinear and contact pad 78 remains distant from conductive tracks 58, 60, 62, 64. No electric connection is thus performed between conductive tracks 58, 60, 62, 64.

According to the present example of implementation of the present invention, the microswitch is set to the first on position by supplying second heating element 84 with a current, while first heating element 82 is not supplied. Second heating element 84 thus generates calories by Joule effect. Beam 72 thus expands at the level of electrode 84 and deforms so that contact pad 78 is substantially displaced to the left of FIG. 2B. Further, according to the present example of implementation, beam 72 exhibits a sufficient rigidity to curve to the bottom of cavity 56 due to the expansion difference between metal portion 76 and beam 72, metal portion 76 expanding more than the area of beam 72 around second heating element 84. The expansion and the curving of beam 72 are sufficient to bring contact pad 78 in contact with first conductive tracks 58, 60.

The maintaining of microswitch 50 in the first on position may be ensured by previously imposing a voltage difference between electrodes 66, 68 and the associated complementary electrodes 86, 88. The obtained electrostatic forces tend to bring complementary electrodes 86, 88 closer to the associated electrodes 66, 68. The intensity of the electrostatic forces to be provided may be low since complementary electrodes 86, 85 have already been brought closer to electrodes 66, 68 upon deformation of beam 72. The voltage difference to be provided is on the order of some ten volts. Further, the voltage applied between electrode 66 and the associated complementary electrode 86 closest to conductive tracks 58, 60 connected by contact pad 78 may be greater than the voltage applied between electrode 68 and the associated complementary electrode 88 most distant from conductive tracks 62, 64 connected by contact pad 78.

Figure 2D:
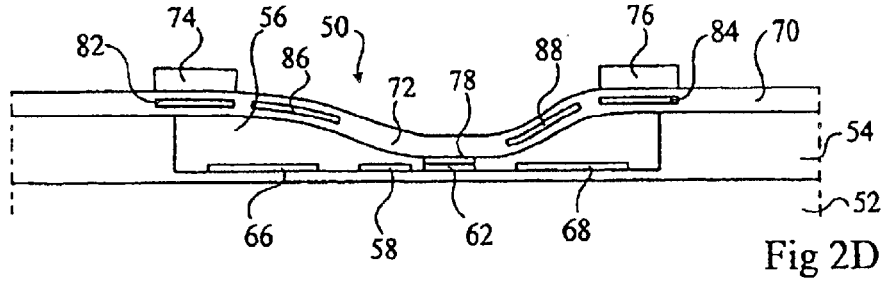

FIG. 2D shows the setting to the second on position of the microswitch according to the present example of implementation. Only first heating-element 82, and not second heating element 84, is supplied with a current. The heat generated by Joule effect causes the expansion and the curving of beam 72 to bring pad 78 in contact with second conductive tracks 62, 64. The maintaining of the microswitch in the second on position is obtained by previously imposing a voltage difference between complementary electrodes 86, 88 and electrodes 66, 68. As described previously, the voltage applied between electrode 68 and the associated complementary electrode 88 closest to conductive tracks 62, 64 connected by contact pad 78 may be greater than the voltage applied between electrode 66 and the associated complementary electrode 86 most distant from conductive tracks 62, 64 connected by contact pad 78.

According to another example of implementation of the present invention, not shown, metal portions 74, 76 are suppressed. Heating elements 82, 84 are then essentially used to ensure the expansion of beam 72 and enable lateral motion of contact pad 78 to bring it closer to first 58, 60 or second 62, 64 conductive tracks according to which heating element 82, 84 conducting a current.

The bringing of pad 78 closer to the bottom of cavity 56 is ensured by imposing a voltage difference between complementary electrodes 86, 88 and electrodes 66, 68. Contact pad 78 being already moved laterally with respect to the idle position by the expansion of beam 72, the electrostatic forces that tend to bring complementary electrodes 86, 88 closer to electrodes 66, 68 are sufficient to put in contact pad 78 with first 58, 60 or second 62, 64 conductive tracks. According to an alternative, a voltage may be only applied between electrode 66 and the associated complementary electrode 86 closest to conductive tracks 58, 60 connected by contact pad 78.

It is then advantageous to provide rigidification elements integrated to beam 72 that bias a curving of beam 72 towards the bottom of cavity 56 when it expands. This enables reducing the amplitude to be provided for the electrostatic forces and thus the amplitude of the voltage to be applied between complementary electrodes 86, 88 and electrodes 66, 68.

According to yet another example of implementation of the present invention, the putting in contact of pad 78 with first 58, 60 or second 62, 64 metal tracks is only ensured by selectively applying a voltage between metal electrode 66, 68 and the associated complementary electrode 86, 88 closest to conductive tracks 58, 60, 62, 64 to be connected, without heating the beam 72. Beam 72 is formed of a material, for example, a polymer, capable of deforming both in a direction perpendicular to the plane of beam 72 and in the plane of beam 72 under the action of small-amplitude urges. Thus, by placing in adapted fashion electrodes 66, 68 and complementary electrodes 86, 88, the application of a voltage between a metal electrode 66, 68 and the associated complementary electrode 86, 88 is sufficient to deform beam 72 so that pad 78 comes in contact with conductive tracks 58, 60, 62, 64 which are adjacent to metal electrode 66, 68.

A voltage may be applied between the electrode and the associated complementary electrode most distant from conductive tracks 58, 60, 62, 64 to be connected to favor the deformation of beam 72 towards the bottom of cavity 56. However, this voltage is then sufficiently small as compared to the voltage applied between the electrode and the associated complementary electrode closest to the conductive tracks to be connected, for the lateral motion of pad 78 to remain sufficient.

The present invention enables forming of a three-position microswitch which, in particular for applications to microscopic scales, enables a reduced surface area on the same order as that of a conventional dual-position microswitch.

The previously-described example of implementation relates to a three-position microswitch. The present invention also enables forming of a microswitch with more than three positions. As an example, the mobile portion, instead of being a beam, may consist of a resilient layer, for example, a polymer, covering a cavity at the bottom of which extend several conductive tracks. A contact pad is connected to the resilient layer on the side of the layer opposite to the cavity bottom. In off position, the resilient layer is for example substantially planar and the contact pad is distant from the conductive tracks. The layer is capable of being deformed to bring the contact pad closer to the cavity bottom, to bring it in contact with at least one out of two conductive tracks. The microswitch is then in on position.

Since a resilient layer can be deformed according to a higher number of possible configurations than a beam, more than two on positions can be provided. As an example, it is possible to provide four on positions for which the contact pad is brought to the cavity bottom level according to the four corners of a square. The deformation of the resilient layer can be obtained, as described previously in more detail, by the use of electrostatic forces or by a localized expansion of the layer, or the combination thereof.

Generally, the present invention provides manufacturing of a microswitch with at least three positions for applications to microscopic scales according to manufacturing technologies that differ little from dual-position microswitch manufacturing technologies.

All of the above U.S. patents, U.S. patent application publications, U.S. patent applications, foreign patents, foreign patent applications and non-patent publications referred to in this specification and/or listed in the Application Data Sheet are incorporated herein by reference, in their entireties.

Figure 2E:
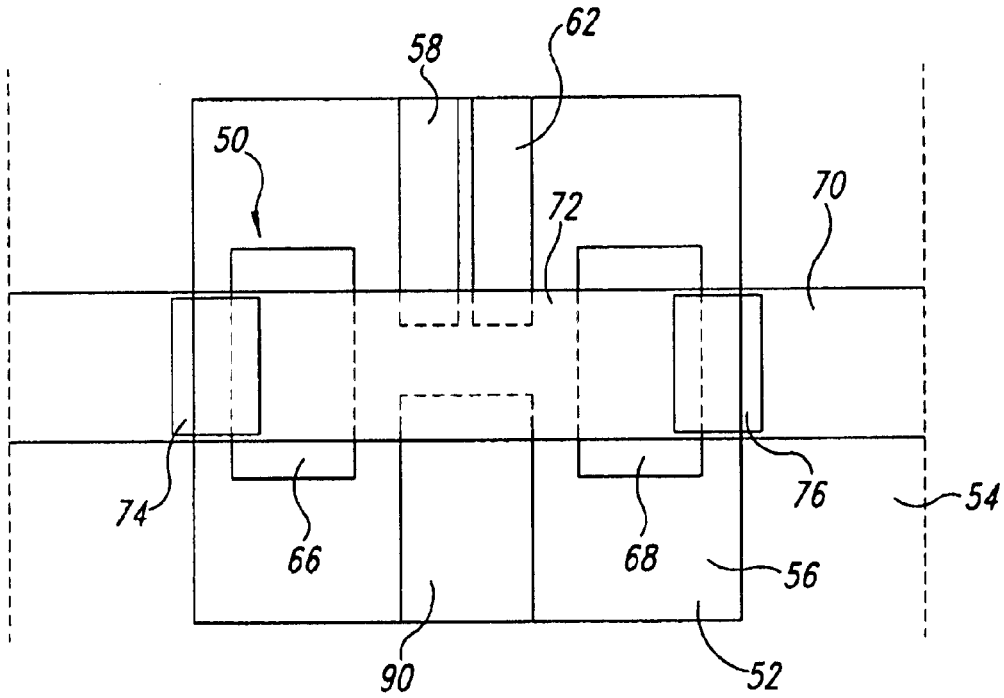

Of course, the present invention is likely to have various alterations, modifications, and improvements which will readily occur to those skilled in the art. In particular, the examples of implementation have been described for microswitches having four conductive tracks that can be connected two by two. It should be clear that the microswitch may comprise three conductive tracks, one conductive track 90 being selectively connectable to one of the other two conductive tracks (FIG. 2E). In addition, the microswitch may comprise only two conductive tracks on the bottom of the cavity and a third conducive track permanently connected to the contact pad and extending through the deformable beam. Also, the conductive tracks could be positioned on opposite sides of the cavity and the deformable beam could be deformed laterally and/or downward to provide contact between the contact pads on the conductive tracks. Further, the described examples of implementation comprise means for providing electrostatic forces. It should be clear that electromagnetic forces could be implemented to deform the beam, for example, by using a contact pad, conductive tracks, or electrodes formed of a ferromagnetic material. In addition, the microswitch can also be implemented as a two position switch that switches back and forth between the two on positions without returning to, or even having, an off position.

Such alterations, modifications, and improvements are intended to be part of this disclosure, and are intended to be within the spirit and the scope of the present invention. Accordingly, the foregoing description is by way of example only and is not intended to be limiting. The present invention is limited only as defined in the following claims and the equivalents thereto.

What is claimed is:

1. A multiposition microswitch, comprising;

a cavity formed in an insulating support and having a bottom;

a deformable mobile portion made of a deformable material extending above said cavity and having ends connected to the insulating support and having a lower surface;

at least three conductive tracks extending on the cavity bottom;

a contact pad on the lower surface of the mobile portion;

stressing means for deforming the mobile portion from an idle position where the contact pad is distant from the conductive tracks to an on position from among plural distinct on positions, the contact pad electrically connecting, in each distinct on position, at least two of the at least three conductive tracks, at least one of the conductive tracks connected to the contact pad in each distinct on position being different from the conductive tracks connected to the contact pad in the other distinct on positions.

2. The microswitch of claim 1 wherein said stressing means are capable of providing forces of attraction on the mobile portion to maintain it in one of the distinct on positions.

3. The microswitch of claim 1 wherein said stressing means are capable of providing forces of attraction on the mobile portion to deform it from the idle position selectively to one of the distinct on positions.

4. The microswitch of claim 1 wherein the mobile portion is a beam spanning the cavity and having beam ends connected to the insulating support and wherein the beam is capable of deforming from the idle position to a first one of the on positions where the contact pad electrically connects two first conductive tracks of the at least three conductive tracks and to a second one of the on positions, distinct from the first on position, where the contact pad electrically connects two second conductive tracks of the at least three conductive tracks, at least one of the second conductive tracks being distinct from the first conductive tracks.

5. The microswitch of claim 4, wherein said stressing means comprise first and second electrodes in the cavity and first and second complementary electrodes connected to the beam and respectively associated with the first and second electrodes, a potential difference being applied between the first electrode and the first complementary electrode to deform the beam from the idle position to the first on position, and a potential difference being applied between the second electrode and the second-complementary electrode to deform the beam from the idle position to the second on position.

6. The microswitch of claim 4 wherein said stressing means comprise first and second expandable portions respectively arranged close to the respective beam ends, the beam being capable of deforming to the first on position when the first expandable portion is heated, the second expandable portion being not or only slightly heated and being capable of deforming to the second on position when the second expendable portion is heated, the first expandable portion being not or only slightly heated.

7. The microswitch of claim 4 wherein the beam is rectilinear in its idle position.

8. The microswitch of claim 1 wherein said stressing means comprise heating elements comprised in the mobile portion, the heating elements being located close to respective ends of the mobile portion and being capable of providing heat upon flowing of a current in the heating elements.

9. The microswitch of claim 1 wherein said stressing means comprise expandable portions formed of a material having an expansion coefficient greater than that of the mobile portion, each expandable portion being connected to the mobile portion on a side opposite to the cavity, and arranged at one end of the mobile portion.

10. The microswitch of claim 1 wherein the mobile portion is made of a polymer.

11. A microswitch, comprising;

a support structure having a cavity formed in a surface of the support structure, the support structure having a cavity bottom defining a bottom of the cavity;

a deformable structure-made of a deformable material extending above the cavity and connected to the support structure and having a lower surface;

a contact pad on the lower surface of the deformable structure;

first and second conductive tracks positioned on the support structure and in the cavity;

stressing means for deforming the deformable structure to a first on position in which the contact pad contacts the first conductive track and to a second on position in which the contact pad contacts the second conductive track.

12. The microswitch of claim 11 wherein the stressing means include a first attraction structure coupled to the deformable structure and a second attraction structure coupled to the cavity bottom, the first and second attraction structures being attracted to each other in response to current being driven through at least one of the attraction structures.

13. The microswitch of claim 11 wherein the stressing means include first and second attraction structures that are structured to provide a force of attraction sufficient to deform the deformable structure selectively to the on positions.

14. The microswitch of claim 11 wherein the deformable structure is a beam spanning the cavity and having beam ends connected to the support structure.

15. The microswitch of claim 11, wherein the stressing means comprise first and second electrodes on the cavity bottom and first and second complementary electrodes connected to the deformable structure and respectively associated with the first and second electrodes, a potential difference being applied between the first electrode and the first complementary electrode to deform the deformable structure to the first on position, and a potential difference being applied between the second electrode and the second complementary electrode to deform the deformable structure to the second on position.

16. The microswitch of claim 11 wherein the stressing means comprise first and second expandable structure respectively positioned in contact with the deformable structure and close to respective sides of the cavity, the first expandable structure being structured to deform the deformable structure to the first on position when the first expandable structure is heated, and the second expandable structure being structured to deform the deformable structure to the second on position when the second expandable structure is heated.

17. The microswitch of claim 11, further comprising third and fourth conductive tracks positioned on the cavity bottom and across from the first and second conductive tracks respectively, wherein the contact pad is sized to contact the first and third conductive tracks when the contact pad is in the first on position and is sized to contact the second and fourth conductive tracks when the contact pad is in the second on position.

18. The microswitch of claim 11 wherein the stressing means comprise first and second heating elements formed in the deformable structure and close to respective sides of the cavity, the first heating element being structured to deform the deformable structure to move the contact pad toward the first on position when heated by current flow, and the second heating element being structured to deform the deformable structure to move the contact pad toward the second on position when heated by current flow.

19. The microswitch of claim 11 wherein the stressing means include means for deforming the deformable structure from an off position in which the contact pad is distant from the conductive tracks to either of the on positions.

20. A method of operating a multiposition microswitch that includes a support structure having a cavity formed in a surface of the support structure; a deformable structure extending above the cavity, being connected to the support structure, and having a lower surface; a contact pad on the lower surface of the deformable structure; and first and second conductive tracks positioned on the support structure and in the cavity, the method comprising:

deforming the deformable structure to a first on position in which the contact pad contacts the first conductive track; and deforming the deformable structure to a second on position in which the contact pad contacts the second conductive track.

21. The method of claim 20 wherein the step of deforming the deformable structure to the first on position includes electrostatically attracting a first attraction structure, coupled to the deformable structure, to a second attraction structure positioned near the first on position; and the step of deforming the deformable structure to the second on position includes electrostatically attracting a third attraction structure, coupled to the deformable structure, to a fourth attraction structure positioned near the second on position.

22. The method of claim 20, further comprising:

maintaining the deformable structure in the first on position by electrostatically attracting a first attraction structure, coupled to the deformable structure, to a second attraction structure positioned near the first on position; and maintaining the deformable structure in the second on position by electrostatically attracting a third attraction structure, coupled to the deformable structure, to a fourth attraction structure positioned near the second on position.

23. The method of claim 20, further comprising, maintaining the deformable structure in the first on position by electromagnetically attracting a first attraction structure, coupled to the deformable structure, to a second attraction structure positioned near the first on position; and maintaining the deformable structure in the second on position by electromagnetically attracting a third attraction structure, coupled to the deformable structure, to a fourth attraction structure positioned near the second on position.

24. The method of claim 20 wherein the step of deforming the deformable structure to the first on position includes heating a first portion of the deformable structure and the step of deforming the deformable structure to the second on position includes heating a second portion of the deformable structure.

25. The method of claim 20 wherein the step of deforming the deformable structure to the first on position includes heating a first expandable structure contacting a first portion of the deformable structure and the step of deforming the deformable structure to the second on position includes heating a second expandable structure contacting a second portion of the deformable structure.

26. The method of claim 20, wherein the microswitch also includes third and fourth conductive tracks positioned across from the first and second conductive tracks respectively, and wherein the step of deforming the deformable structure to the first on position includes providing contact between the first and third conductive tracks and the step of deforming the deformable structure to the second on position includes providing contact between the second and fourth conductive tracks.

27. The method of claim 20 wherein the step of deforming the deformable structure to the first on position includes deforming the deformable structure from an off position in which the contact pad is distant from the conductive tracks to the first on position and the step of deforming the deformable structure to the second on position includes deforming the deformable structure from the off position to the second on position.

28. The method of claim 20, wherein the microswitch also includes a third conductive track positioned across from the first and second conductive tracks, and wherein the step of deforming the deformable structure to the first on position includes providing contact between the first and third conductive tracks and the step of deforming the deformable structure to the second on position includes providing contact between the second and third conductive tracks.

* * * * *